US011394147B2

(12) United States Patent
Mangstl

(10) Patent No.: US 11,394,147 B2
(45) Date of Patent: Jul. 19, 2022

(54) CONNECTING PLUG WITH CENTRAL PIN AND LAMELLA SLEEVE, METHOD FOR FORMING THE CONNECTING PLUG AND CONNECTING SOCKET WITH LAMELLA SLEEVE

(71) Applicant: ODU GmbH & Co. KG, Mühldorf (DE)

(72) Inventor: Alfred Mangstl, Neumarkt-Sankt Veit (DE)

(73) Assignee: ODU GmbH & Co. KG, Mühldorf (DE)

( * ) Notice: Subject to any disclaimer, the term of this patent is extended or adjusted under 35 U.S.C. 154(b) by 0 days.

(21) Appl. No.: 16/913,206

(22) Filed: Jun. 26, 2020

(65) Prior Publication Data

US 2021/0005995 A1 Jan. 7, 2021

(30) Foreign Application Priority Data

Jul. 1, 2019 (EP) ..... 19183650

(51) Int. Cl.

| | |
|---|---|
| ***H01R 13/66*** | (2006.01) |
| ***H01R 13/05*** | (2006.01) |
| ***H01R 13/11*** | (2006.01) |
| ***H01R 13/193*** | (2006.01) |
| ***H01R 43/00*** | (2006.01) |

(52) U.S. Cl.

CPC ..... *H01R 13/052* (2013.01); *H01R 13/111* (2013.01); *H01R 13/193* (2013.01); *H01R 43/00* (2013.01)

(58) Field of Classification Search

CPC ... H01R 13/6315; H01R 12/91; H01R 12/585
USPC ..... 439/248, 247
See application file for complete search history.

(56) References Cited

U.S. PATENT DOCUMENTS

| | | | | |
|---|---|---|---|---|
| 4,752,253 | A | 6/1988 | Neumann et al. | |
| 5,653,615 | A | 8/1997 | Inaba et al. | |
| 5,667,413 | A | 9/1997 | Trafton | |
| 6,250,974 | B1 | 6/2001 | Kerek | |
| 9,653,831 | B2 * | 5/2017 | Hoyack | H01R 12/91 |
| 2002/0049005 | A1 | 4/2002 | Leve | |
| 2011/0143595 | A1 | 6/2011 | Facco et al. | |
| 2016/0118736 | A1 | 4/2016 | Hoyack et al. | |
| 2019/0036258 | A1 * | 1/2019 | Tanikawa | H01R 13/055 |
| 2019/0109397 | A1 | 4/2019 | Sugiura et al. | |

FOREIGN PATENT DOCUMENTS

| | | | |
|---|---|---|---|
| CH | 112086 | A | 10/1925 |
| CN | 101103497 | A | 1/2008 |
| CN | 201898221 | U | 7/2011 |
| CN | 203503846 | U | 3/2014 |

(Continued)

*Primary Examiner* — Phuong Chi Thi Nguyen
(74) *Attorney, Agent, or Firm* — WC&F IP

(57) ABSTRACT

A connecting plug is described. The connecting plug comprises a central pin and a lamella sleeve, with the lamella sleeve comprising a front opening, a rear opening and a plurality of lamellae. The lamella sleeve circumferentially encloses an axial segment of the central pin and wherein the lamella sleeve is fixed to the central pin. The central pin extends through the rear opening, through the lamella sleeve and through the front opening of the lamella sleeve.

14 Claims, 9 Drawing Sheets

(56) References Cited

FOREIGN PATENT DOCUMENTS

| | | | |
|---|---|---|---|
| CN | 104852183 | A | 8/2015 |
| CN | 207426271 | U | 5/2018 |
| CN | 108701928 | A | 10/2018 |
| CN | 207947409 | U | 10/2018 |
| DE | 38 08 632 | C1 | 10/1989 |
| DE | 296 01 407 | U1 | 5/1996 |
| DE | 199 09 107 | A1 | 9/2000 |
| DE | 100 41 516 | A1 | 3/2002 |
| DE | 102004002402 | B3 | 11/2005 |
| DE | 20 2005 015 800 | U1 | 1/2006 |
| EP | 3 641 068 | A1 | 4/2020 |
| RU | 2 528 171 | C2 | 9/2014 |

* cited by examiner

CONNECTING PLUG WITH CENTRAL PIN AND LAMELLA SLEEVE, METHOD FOR FORMING THE CONNECTING PLUG AND CONNECTING SOCKET WITH LAMELLA SLEEVE

FIELD OF THE INVENTION

The invention relates to a connecting plug comprising a central pin and a lamella sleeve. The invention further relates to a plug-in connector comprising a connecting plug and a corresponding socket. Furthermore, the invention relates to a method for forming a connecting plug by assembling a central pin and a lamella sleeve. The invention further relates to a connecting socket comprising a socket element and a lamella sleeve.

BACKGROUND OF THE INVENTION

German patent DE 38 08 632 C1 describes a coaxial plug-in connector with an inner conductor plug connection. The inner conductor plug connection comprises a rigid, metallic socket part and a plug part, wherein the plug part's front portion, which is insertable in the socket part, has a reduced outer diameter and ends at an annular shoulder which forms a stop for the edge of the socket part. As the front portion of the plug part is enclosed by a contact pot, an accurate centrical fit of the plug part in the socket part and a consistently good contact along the circumference is accomplished. The bottom of the contact pot is tightly connected to the end face of the plug part, whereas the wall of the contact pot has a configuration that is resilient in radial direction, the configuration being chosen such that the largest outer diameter lies in the area of the contact pot's edge.

German patent application DE 100 41 516 A1 describes an electrical connection device for high currents. The electrical connection device comprises a receptacle for an electrical conductor to which the connection device is to be permanently attached, and a resilient plug contact comprising a plurality of resilient lamellae for connection to a mating connector. The receptacle and the plug contact are made of separate parts and these parts are non-detachably connected by means of a rivet connection.

In U.S. Pat. No. 5,667,413 A, a socket-type electrical connector is described. A female electrical connector includes a housing defining a generally cylindrical bore therewithin. The connector includes a contact cage disposed, and retained, within the housing. The contact cage includes a number of contact blades disposed so as to provide a radial resilience. The connector provides a high current capacity, low insertion force connector which may be readily fit over post-type electrical terminals.

OBJECT OF THE INVENTION

The object of the invention is to provide a connecting plug or a connecting socket comprising a plurality of resilient lamellae, wherein the manufacturing of the connecting plug or the connecting socket is simplified.

SUMMARY OF THE INVENTION

According to the invention, a connecting plug is provided. The connecting plug comprises a central pin and a lamella sleeve, with the lamella sleeve comprising a front opening, a rear opening and a plurality of lamellae. The lamella sleeve circumferentially encloses an axial segment of the central pin and the lamella sleeve is fixed to the central pin. The central pin extends through the rear opening, through the lamella sleeve and through the front opening of the lamella sleeve.

The connecting plug of the present invention is produced by assembling the central pin and the lamella sleeve. The lamella sleeve may for example be slid onto the front portion of the central pin such that the central pin extends through the rear opening, the lamella sleeve and the front opening. In this position, the lamella sleeve encloses an axial segment of the central pin. An axial segment of the central pin is a portion of the central pin that has a certain extension in the connecting plug's mating direction. As the central pin extends both through the rear opening and the front opening of the lamella sleeve, the lamella sleeve is reliably supported by the central pin and a stable mechanical attachment is accomplished. The front end of the central pin may for example be shaped as a tip that extends beyond the front opening of the lamella sleeve.

According to the invention, the plug-in connector with resilient lamellae is obtained by assembling two parts. Each of the two parts can be manufactured using a manufacturing technique that is particularly suitable for the respective part. For example, for manufacturing the lamella sleeve, a different manufacturing technique may be used than for manufacturing the central pin. By combining two different manufacturing techniques, the advantages of two different techniques can be combined. Each of the two parts can be produced in large quantities at low cost. For this reason, the plug-in connector of the present invention can be produced in a cost-effective manner.

In the present application, terms such as "front portion", "front end", "front opening", "rear end", "rear opening", "rear edge" relate to the connecting plug's mating direction. The mating direction is the direction in which the plug is inserted into a socket. Accordingly, the front end of the connecting plug is the part of the plug that is inserted into the socket first.

Further according to the invention, a connecting plug is provided. The connecting plug comprises a central pin and a lamella sleeve, with the lamella sleeve comprising a front opening, a rear opening, an annular carrier part and a plurality of lamellae. The central pin extends through the rear opening of the lamella sleeve and at least partly through the lamella sleeve, with the lamella sleeve circumferentially enclosing an axial segment of the central pin. The lamella sleeve is fixed to the central pin. Viewed in the connecting plug's mating direction, the annular carrier part is located at a rear portion and the lamellae are located at a front portion of the lamella sleeve, wherein each of the lamellae has a first end coupled to the annular carrier part and a second end that is implemented as a free end, with the free ends of the lamellae facing towards the front end of the connecting plug.

The connecting plug of the present invention is produced by assembling two parts, a central pin and a lamella sleeve. The lamella sleeve is slid onto the central pin such that the central pin extends through the rear opening of the lamella sleeve and at least partly through the lamella sleeve. The lamella sleeve encloses an axial segment of the central pin. In this regard, an axial segment is a portion of the central pin having a certain extension in the connecting plug's mating direction.

The lamellae are located at a front portion of the lamella sleeve. Each of the lamellae has a free end and a fixed end, with the free end facing towards the connecting plug's front end.

Thus, when inserting the connecting plug into the socket, the lamellae are resiliently deformed right at the beginning of the insertion process. When inserting the plug into the socket, a certain resistance has to be overcome, which provides a tactile feedback to the user. A further advantage is that the electrical contact with the socket is established right at the beginning of the insertion process. Yet another advantage of the connecting plug is that the axial position of the lamellae's contact points is exactly defined. As a consequence, during the insertion process, electrical contact is established at a well-defined point of the insertion process.

The connecting plug of the present invention is produced by assembling a central pin and a lamella sleeve. Each of these two parts can be produced using a suitable manufacturing technique. Thus, the advantages of different manufacturing techniques can be combined. Each of the two parts can be manufactured in large quantities at low cost.

Further according to the invention, a plug-in connector is provided, the plug-in connector comprising a connecting plug as described above and a corresponding socket.

Further according to the invention, a method for forming a connecting plug by assembling a central pin and a lamella sleeve is provided. The lamella sleeve comprises a front opening, a rear opening and a plurality of lamellae. The method comprises a step of sliding the lamella sleeve on the central pin, with the central pin extending through the rear opening, through the lamella sleeve and through the front opening of the lamella sleeve, wherein the lamella sleeve circumferentially encloses an axial segment of the central pin. The method further comprises a step of fixing the lamella sleeve to the central pin.

Yet further according to the invention, a connecting socket is provided, the connecting socket comprising a lamella sleeve and a socket element. The lamella sleeve comprises a front opening, an annular carrier part and a plurality of lamellae, wherein each of the lamellae has a first end that is integrally formed with the annular carrier part and a second end that is implemented as a free end. The socket element has an opening configured for accommodating at least a rear part of the lamella sleeve. The lamella sleeve is a deep-drawn part.

The connecting socket of the present invention is produced by assembling a socket element and a lamella sleeve. The lamella sleeve is inserted into the opening of the socket element, wherein at least the rear part of the lamella sleeve is accommodated by the socket element. Thus, the lamella sleeve is at least partly enclosed and protected by the socket element.

Each of the two parts, the socket element and the lamella sleeve, can be produced using a suitable manufacturing technique. The lamella sleeve is formed by deep-drawing. For manufacturing the socket element, a different manufacturing technique like for example turning may be used. Each of the parts can be manufactured in large quantities at low cost. Deep drawing is a well-suited technique for manufacturing the lamella sleeve. Deep drawing allows to manufacture the resilient lamellae of the lamella sleeve with high precision. A lamella sleeve that is formed as a deep-drawn part is not prone to be damaged in case a connector pin is inserted into the socket in a slanted direction or in case a tumbling motion of a connector pin occurs when the connector pin is inserted into the socket.

In the present application, terms such as "front portion", "front end", "front opening", "rear end", "rear opening", "rear edge" relate to the connecting socket's mating direction. The mating direction is the direction of movement of the connecting socket relative to the connecting plug when the connecting socket and the connecting plug are mated.

PREFERRED EMBODIMENTS OF THE INVENTION

Preferred features of the invention which may be applied alone or in combination are discussed below and in the dependent claims.

A Connecting Plug Comprising a Lamella Sleeve

Preferably, the lamella sleeve is of tubular shape. For example, the lamella sleeve's basic shape may be a cylinder jacket of a circular cylinder. This shape of the lamella sleeve is suitable for circumferentially enclosing the central pin.

In a preferred embodiment, each of the lamellae is elastically deformable in a radially inward direction of the lamella sleeve. When the lamellae are deflected in a radially inward direction, the resulting spring force will be directed in a radially outwards direction. When inserting the connecting plug into a socket, the lamellae will be elastically deformed in a radially inward direction and the resulting spring force will press the lamellae in a radially outwards direction against the inner surface of the socket. Due to the resilient deformation of the lamellae, the electrical contact between the plug and the socket is improved.

Preferably, the lamella sleeve and the central pin are oriented coaxially. Further preferably, the central axis of the lamella sleeve corresponds to the central axis of the central pin.

Preferably, viewed in the mating direction of the connecting plug, the lamellae are located at a front portion of the lamella sleeve. By arranging the lamellae at the front portion of the lamella sleeve, the lamellae are deformed at the beginning of the insertion process. A certain resistance has to be overcome at the beginning of the insertion process, which provides a tactile feedback to the user. Preferably, the lamella sleeve comprises a plurality of slots that extend from the lamella sleeve's front end in a predominantly axial direction towards the centre of the lamella sleeve. The slots may for example be configured for segmenting the front portion of the lamella sleeve into a plurality of lamellae. Preferably, by varying the length of the slots, the spring force of the lamellae can be adjusted. Further preferably, by selecting the number of the slots and hence the width of the lamellae, the spring force of the lamellae can be adjusted as well. Further preferably, by varying the spring force of the lamellae, the pushing and pulling forces required for mating and unmating the connector pin and a corresponding socket can be adjusted.

According to a preferred embodiment, when viewed in the mating direction of the connecting plug, the lamellae are circumferentially arranged at the front portion of the lamella sleeve. The lamellae are configured for providing outwardly directed resilient forces.

Preferably, the lamellae extend over at least 20% of the lamella sleeve's length in the axial direction, further preferably over at least 25%, further preferably over at least 30%, further preferably over at least 35% of the lamella sleeve's length in the axial direction. Preferably, the lamellae extend over less than 85% of the lamella sleeve's length in the axial direction, further preferably over less than 75%, further preferably over less than 60%, further preferably over less than 50%, further preferably over less than 40% of the lamella sleeve's length in the axial direction.

Further preferably, each of the lamellae has a first end coupled to an annular carrier part of the lamella sleeve and a second end that is implemented as a free end, with the free ends of the lamellae facing towards the front end of the connecting plug. By attaching the lamellae at one end only, the force required for deflecting the lamellae is decreased. A further advantage is that the electrical contact with the socket is established right at the beginning of the insertion process. Yet another advantage of the connecting plug is that the axial position of the lamellae's contact points is exactly defined. According to an alternatively preferred embodiment, each of the lamellae has a first end coupled to an annular carrier part of the lamella sleeve and a second end that is implemented as a free end, wherein according to this alternatively preferred embodiment, the free ends of the lamellae are facing towards the rear end of the connecting plug. Preferably, the respective first end of a lamella is integrally formed with the annular carrier part.

According to a preferred embodiment, the lamellae extend towards the front end of the connecting plug. Preferably, the lamellae extend predominantly in a mating direction of the connecting plug. For example, the lamellae may extend along the side faces of the connecting plug.

Preferably, the length of the lamella sleeve in the axial direction is at least 1 times the diameter, further preferably at least 1.5 times the diameter, further preferably at least 2 times the diameter. Preferably, the length of the lamella sleeve is at most 10 times the diameter, further preferably at most 5 times the diameter, further preferably at most 3.5 times the diameter, further preferably at most 2.5 times the diameter.

Preferably, each of the lamellae comprises a bulge that extends in a radially outward direction. The bulge serves as a contact area and is configured for establishing an improved electrical contact between the respective lamella and the socket. Preferably, by varying the shape of the bulge, the insertion force required for inserting the connecting plug into a corresponding socket can be varied. Preferably, the bulges may have a rounded shape. Further preferably, in case of a bulge having a rounded shape, by varying the radius of curvature of the bulge, the insertion force required for inserting the connecting plug into the socket can be varied. For example, the radius of curvature can be chosen such that for inserting the connecting plug into the socket, a well-defined insertion force has to be applied. For example, by varying the shape of the bulge, the insertion behaviour when inserting the connecting plug into the socket can be modified. For example, it can be accomplished that the connecting plug can be smoothly slid into the socket.

According to another preferred embodiment, each lamella comprises two or more bulges that extend in a radially outward direction. Each of the bulges may serve as a contact area for establishing an electrical contact between the lamella and the socket. For example, via the two or more bulges, electrical contact between the lamella and the socket can be established at a plurality of contact areas in parallel. Thus, a reliable electrical contact can be established.

According to a further preferred embodiment, each lamella comprises two or more bulges that extend in a radially outward direction, wherein electrical contact between the lamella and the socket is established via a first one of the bulges, with at least one of the remaining bulges serving as a replacement part. For example, in case a predefined level of wear of the first bulge is reached, electrical contact between the lamella and the socket will be established via at least one of the remaining bulges. The bulges may for example have slightly different radii of curvature. Thus, even in case the contacts are degraded in the course of time, long-term operation of the connecting plug can be ensured.

Preferably, the lamella sleeve consists of conductive material, preferably of metal. Preferably, the lamella sleeve is formed in one piece. Yet further preferably, the lamella sleeve is a rotationally symmetric part. In a preferred embodiment, the lamella sleeve is a deep drawn part. Deep drawing is a suitable technique for manufacturing the resilient lamellae of the lamella sleeve with the required precision in large quantities at low costs. Furthermore, a lamella sleeve that is formed as a deep-drawn part is not prone to be damaged in case the connector pin is inserted in a slanted direction or in case a tumbling motion of the connector pin occurs during the mating process.

Preferably, the lamella sleeve is configured for being slid on the central pin. The central pin may for example extend through the rear opening of the lamella sleeve and at least partly through the lamella sleeve. Further preferably, the central pin may for example extend through the rear opening, through the entire lamella sleeve and through the front opening.

According to a preferred embodiment, the central pin comprises a circumferential recess, with the rear end of the lamella sleeve abutting against the rear end of the circumferential recess, wherein the circumferential recess is configured for determining the axial position of the lamella sleeve relative to the central pin. Accordingly, the lamella sleeve may be slid onto the central pin until the rear end of the lamella sleeve abuts against the rear end of the circumferential recess, with said recess serving as a limit stop that defines the axial position of the lamella sleeve.

According to a further preferred embodiment, the central pin comprises a tapered portion that tapers in the axial direction towards the front end of the connecting plug. The lamella sleeve can be pushed onto the tapered portion and the lamella sleeve can be fixed to the central pin. Preferably, the lamella sleeve is fixed to the central pin by means of a press fit.

Preferably, the central pin has a circular cross section. The lamella sleeve may for example have a ring-shaped cross section.

Preferably, the central pin consists of conductive material, preferably of metal. Further preferably, the central pin is formed in one piece. Preferably, the central pin is a solid part. According to a preferred embodiment, the central pin is a rotationally symmetric part. Preferably, the central pin is a turned part. Turning is a suitable technique for manufacturing the central pin, because the central pin is a solid part that is rotationally symmetric. For manufacturing the lamella sleeve, deep drawing is a suitable technique. By joining the central pin and the lamella sleeve, each manufactured with a different manufacturing technique, the advantages of both manufacturing techniques can be combined. In particular, the lamella sleeve may be formed by deep drawing, whereas the central pin may be formed by turning.

Preferably, the lamella sleeve is fixed to the central pin using at least one of the following joining techniques: flanging, crimping, beading, clamping, establishing a press fit.

Preferably, the central pin protrudes beyond the front end of the lamella sleeve. The central pin may for example comprise a tip at its front end. For example, the central pin may form a tip in the portion that protrudes beyond the front end of the lamella sleeve.

In a further preferred embodiment, the central pin consists of at least two different components. Preferably, the central pin comprises a contact pin and an insulating end part attached to the front end of the contact pin.

Preferably, the contact pin consists of conductive material, preferably of metal. Further preferably, the contact pin is a rotationally symmetric part. Preferably, the contact pin is a turned part. Preferably, the insulating end part consists of insulating material. Further preferably, the insulating end part consists of one of: plastic material, an elastomer, natural rubber, synthetic rubber. Preferably, the insulating end part is configured for providing a touch protection at the front end of the connecting plug. Preferably, the insulating end part is fixed to the front end of the contact pin by one of the following joining techniques: screwing, caulking, establishing a press fit. Preferably, the insulating end part comprises one or more snap-in members configured for establishing a snap-fit with the contact pin.

In a further preferred embodiment, the central pin comprises a contact pin and an insulating cap configured for covering a tip of the contact pin. Preferably, the insulating cap is configured for establishing a snap-fit with the tip of the contact pin. Preferably, the insulating cap consists of insulating material. Preferably, the insulating cap is configured for providing a touch protection at the front end of the connecting plug.

According to a preferred embodiment, each of the lamellae has a first end coupled to an annular carrier part of the lamella sleeve and a second end that is implemented as a free end, with the free ends of the lamellae facing towards the front end of the connecting plug, wherein the tip is configured for protecting the free ends of the lamellae and for preventing a plastic deformation of the lamellae. For example, the tip may at least partly cover the free ends of the lamellae. Thus, it may for example be prevented that any item can be inserted in the space between the central pin and the lamellae and that the lamellae are bent in a radially outward direction. Thus, the tip may be configured for preventing damage of the lamellae.

Preferably, the central pin comprises a groove, a recess or at least one indentation. The central pin may for example comprise a circumferential groove or a circumferential recess. According to a preferred embodiment, the groove, the recess or the at least one indentation is arranged such that a free space is provided behind the front portions of the lamellae. The free space behind the lamellae allows for a movement of the lamellae in the radially inwards direction. Forces acting on the lamellae cause a resilient deformation of the lamellae. Thus, the lamellae can absorb forces acting on them.

Preferably, viewed in the mating direction, the axial dimension of the groove, the recess or the at least one indentation extends beyond the free ends of the lamellae. Preferably, the axial dimension of the groove, the recess or the at least one indentation overlaps with the front portion of the lamellae when viewed in the mating direction. If an inwardly directed force acts on the free ends of the lamellae, the free ends will be pushed into the groove, the recess or the at least one indentation.

In a preferred embodiment, a respective depth of the groove, of the recess or of the at least one indentation determines a maximum deflection of the lamellae. By limiting the deflection of the lamellae, damages of the lamellae are avoided. Preferably, the bottom of the groove, of the recess or of the at least one indentation serves as a support for the deflected lamellae. In particular, the bottom of the groove serves as a limit stop for limiting the deformation of the lamellae and for preventing any damages. Further preferably, the respective depth of the groove, the recess or the at least one indentation is chosen such that any plastic deformation of the lamellae is prevented. Thus, a more robust construction of the connecting plug is obtained.

In a preferred embodiment, the axial position of the rear end of the groove, of the recess or of the at least one indentation relative to the lamella sleeve determines the length of the respective deformable portions of the lamellae. By varying the axial position of the rear end of the groove, the recess or the at least one indentation, the length of the deformable portion can be adjusted. By moving the rear end's position towards the lamellae's free ends, the deformable portions are shortened. In contrast, by moving the rear end's position away from the free end, the length of the deformable portion is increased.

Preferably, a rear edge of the groove, of the recess or of the at least one indentation serves as an abutting edge for the lamellae. When a force acts on a respective lamella, the lamella abuts against the rear edge of the groove, of the recess or of the at least one indentation, and only the front portion is deformed.

Further preferably, the axial position of the rear end of the groove, the recess or the at least one indentation relative to the lamella sleeve determines the spring tension of the lamellae. The longer the deformable portion is, the softer the spring tension of the lamellae will be. In contrast, by reducing the length of the deformable portion, a comparatively hard spring tension of the lamellae is obtained. Preferably, the spring tension of the lamellae determines an insertion force when inserting the connecting plug into a corresponding socket.

A Plug-in Connector Comprising a Connecting Plug and a Socket

A plug-in connector comprises a connecting plug as described above and a corresponding socket. Preferably, the socket comprises a circumferential recess or a circumferential groove configured for latching with the bulges of the connecting plug's lamellae when the connecting plug is inserted into the socket. For example, by varying the size, the depth and the shape of the circumferential recess or the circumferential groove, the force required for unmating the connecting plug and the socket can be set to a desired value.

A Connecting Socket Comprising a Lamella Sleeve

Preferably, the lamella sleeve is of tubular shape. In a further preferred embodiment, the lamella sleeve comprises a closed base at the lamella sleeve's rear end. A lamella sleeve with closed base can for example be formed by deep-drawing.

In a preferred embodiment, each of the lamellae is elastically deformable in a radially outwards direction of the lamella sleeve. When the lamellae are deflected in a radially outwards direction, the resulting spring force will press the lamellae in a radially inwards direction, for example against the surface of a contact pin.

Preferably, the lamella sleeve and the socket element are oriented coaxially. Further preferably, the central axis of the lamella sleeve corresponds to the central axis of the socket element.

Preferably, the lamella sleeve comprises a plurality of slots that extend from the lamella sleeve's front end in a predominantly axial direction towards the centre of the lamella sleeve. The slots may for example be configured for segmenting the front portion of the lamella sleeve into a plurality of lamellae. Preferably, by varying at least one of the length of the slots and the number of the slots, the spring force of the lamellae can be adjusted.

According to a preferred embodiment, when viewed in the mating direction of the connecting socket, the lamellae are circumferentially arranged at the front portion of the lamella sleeve.

Preferably, the lamellae extend over at least 20% of the lamella sleeve's length in the axial direction, further preferably over at least 25%, further preferably over at least 30%, further preferably over at least 35% of the lamella sleeve's length in the axial direction. Preferably, the lamellae extend over less than 85% of the lamella sleeve's length in the axial direction, further preferably over less than 75%, further preferably over less than 60%, further preferably over less than 50%, further preferably over less than 40% of the lamella sleeve's length in the axial direction.

Preferably, the length of the lamella sleeve in the axial direction is at least 1 times the diameter, further preferably at least 1.5 times the diameter, further preferably at least 2 times the diameter. Preferably, the length of the lamella sleeve is at most 10 times the diameter, further preferably at most 5 times the diameter, further preferably at most 3.5 times the diameter, further preferably at most 2.5 times the diameter.

Preferably, each of the lamellae comprises a bulge that extends in a radially inward direction. Electrical contacts between the lamellae and the connector pin are established via the bulges, which serve as contact areas. Preferably, by varying the shape of the bulge, the insertion force required for inserting a connecting plug into the connecting socket can be varied.

According to a preferred embodiment, the lamella sleeve consists of conductive material, preferably of metal. Yet further preferably, the lamella sleeve is a rotationally symmetric part. Preferably, the socket element consists of conductive material, preferably of metal. Further preferably, the socket element is formed in one piece. Preferably, the socket element is a solid part. According to a preferred embodiment, the socket element is a rotationally symmetric part. Preferably, the socket element is a turned part.

Preferably, the lamella sleeve is fixed to the socket element using at least one of the following joining techniques: establishing a press fit, crimping, flanging, welding.

In a preferred embodiment, when viewed in the connecting socket's mating direction, the annular carrier part is located at a rear portion and the lamellae are located at a front portion of the lamella sleeve, with the free ends of the lamellae facing towards the front end of the connecting socket. The advantage is that the electrical contact with a connecting plug inserted into the socket is established right at the beginning of the insertion process. Yet another advantage is that the axial position of the lamellae's contact points is exactly defined. As a consequence, during the insertion process, electrical contact is established at a well-defined point of the insertion process. According to a preferred embodiment, the lamellae extend towards the front end of the connecting socket. Preferably, the lamellae extend predominantly in a mating direction of the connecting socket.

In an alternatively preferred embodiment, when viewed in the connecting socket's mating direction, the annular carrier part is located at a front portion and the lamellae are located at a rear portion of the lamella sleeve, with the free ends of the lamellae facing towards the rear end of the connecting socket.

Preferably, the socket element circumferentially encloses the lamella sleeve. For example, the lamella sleeve may be circumferentially enclosed by the socket element. In a preferred embodiment, the opening of the socket element is configured for fixing the rear portion of the lamella sleeve.

According to a preferred embodiment, the socket element comprises a recess or a groove or at least one indentation that projects from the opening in a radially outwards direction. The socket element may for example comprise a circumferential groove or a circumferential recess that projects from the opening in a radially outwards direction.

In a preferred embodiment, the recess, the groove or the at least one indentation is arranged such that a free space is provided in a radially outwards direction behind the front portions of the lamellae. Preferably, the free space behind the lamellae allows for a movement of the lamellae in the radially outwards direction. For example, the free space behind the lamellae allows for resiliently deforming the lamellae in the radially outwards direction. Preferably, in case a front portion of a lamella is deformed in a radially outward direction, it enters the free space provided behind the lamellae.

Preferably, viewed in the mating direction, the axial dimension of the groove, the recess or the at least one indentation extends beyond the free ends of the lamellae. Preferably, the axial dimension of the groove, the recess or the at least one indentation overlaps with the front portion of the lamellae when viewed in the mating direction. Therefore the free ends of the lamellae will be pushed into the groove, the recess or the at least one indentation if an outwardly directed force acts on the free ends of the lamellae.

In a preferred embodiment, a respective depth of the recess, of the groove or of the at least one indentation determines a maximum deflection of the lamellae. By limiting the deflection of the lamellae, damages of the lamellae are prevented. Preferably, the bottom of the groove, of the recess or of the at least one indentation serves as a support for the deflected lamellae. Preferably, the bottom of the groove serves as a limit stop for limiting the deformation of the lamellae. Further preferably, the respective depth of the groove, the recess or the at least one indentation is chosen such that any plastic deformation of the lamellae is prevented.

In a preferred embodiment, the axial position of the rear end of the groove, of the recess or of the at least one indentation relative to the lamella sleeve determines the length of the respective deformable portions of the lamellae. When the rear end's position is moved towards the lamellae's free ends, the deformable portions are shortened, and when the rear end's position is moved away from the free end, the length of the deformable portion is increased.

Preferably, a rear edge of the groove, of the recess or of the at least one indentation serves as an abutting edge for the lamellae. When a force acts on a respective lamella, the lamella abuts against the rear edge of the groove, the recess or the at least one indentation, and only the front portion of the lamella is deformed.

Further preferably, the axial position of the rear end of the groove, the recess or the at least one indentation relative to the lamella sleeve determines the spring tension of the lamellae. The longer the deformable portion is, the softer the spring tension of the lamellae will be. In contrast, by reducing the length of the deformable portion, a comparatively hard spring tension of the lamellae is obtained. Preferably, the spring tension of the lamellae determines an insertion force when inserting a connecting plug into the connecting socket.

BRIEF DESCRIPTION OF THE DRAWING

The invention is illustrated in greater detail with the aid of schematic drawings.

It shows schematically.

DETAILED DESCRIPTION OF EMBODIMENTS OF THE INVENTION

Figure 1:
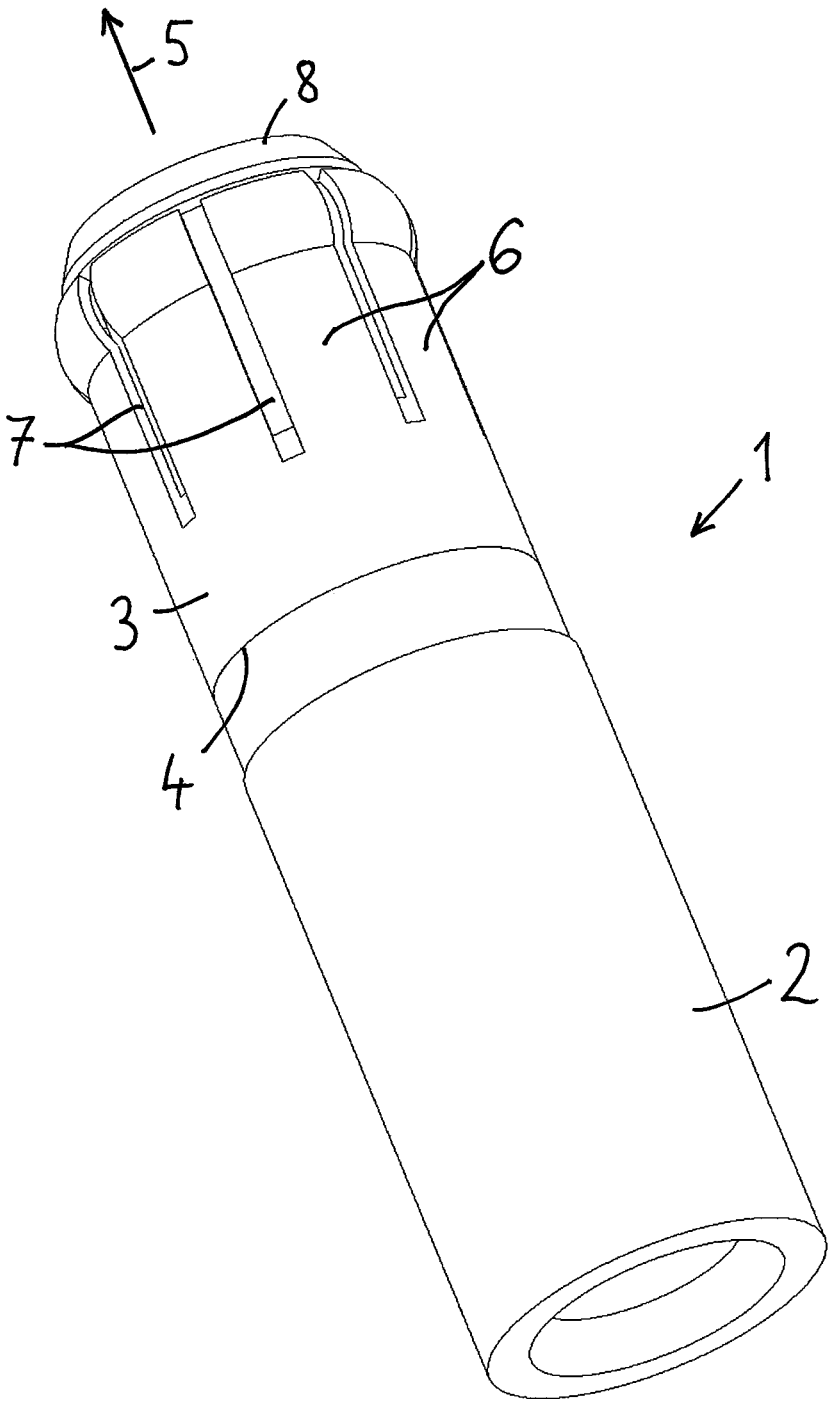
FIG. 1 shows a perspective view of the connecting plug.

In the following description of preferred embodiments of the present invention, identical reference numerals denote identical or comparable components.

FIG. 1 shows a connecting plug 1 comprising a central pin 2 and a lamella sleeve 3. The lamella sleeve 3 is configured for being slid onto a front portion of the central pin 2, with the central pin 2 extending through the lamella sleeve 3. The lamella sleeve 3 circumferentially encloses an axial segment of the central pin 2. The lamella sleeve 3 is fixed to the central pin 2. The rear end of the lamella sleeve 3 is located at a predefined axial position 4.

Viewed in the mating direction 5 of the connecting plug 1, a plurality of lamellae 6 are disposed in the front portion of the lamella sleeve 3. Each of the lamellae 6 has a first end coupled to an annular carrier part of the lamella sleeve 3 and a second end that is implemented as a free end, with the free ends of the lamellae 6 facing towards the front end of the connecting plug 1. The lamellae 6 extend in an axial direction towards the front end of the connecting plug 1. Adjacent lamellae 6 are separated by slots 7 that extend in the axial direction of the lamella sleeve 3. In the example shown in FIGS. 1 to 4, the central pin 2 comprises a tip 8 that is located at the front end of the central pin 2, wherein the tip 8 extends beyond the front end of the lamella sleeve 3 in the mating direction 5.

The connecting plug 1 is configured for being inserted into a corresponding socket (not shown) in the mating direction 5. The lamellae 6 are configured for being elastically deformed in a radially inwards direction and provide a reliable electrical contact with the inner surface of the corresponding socket.

Figure 2:
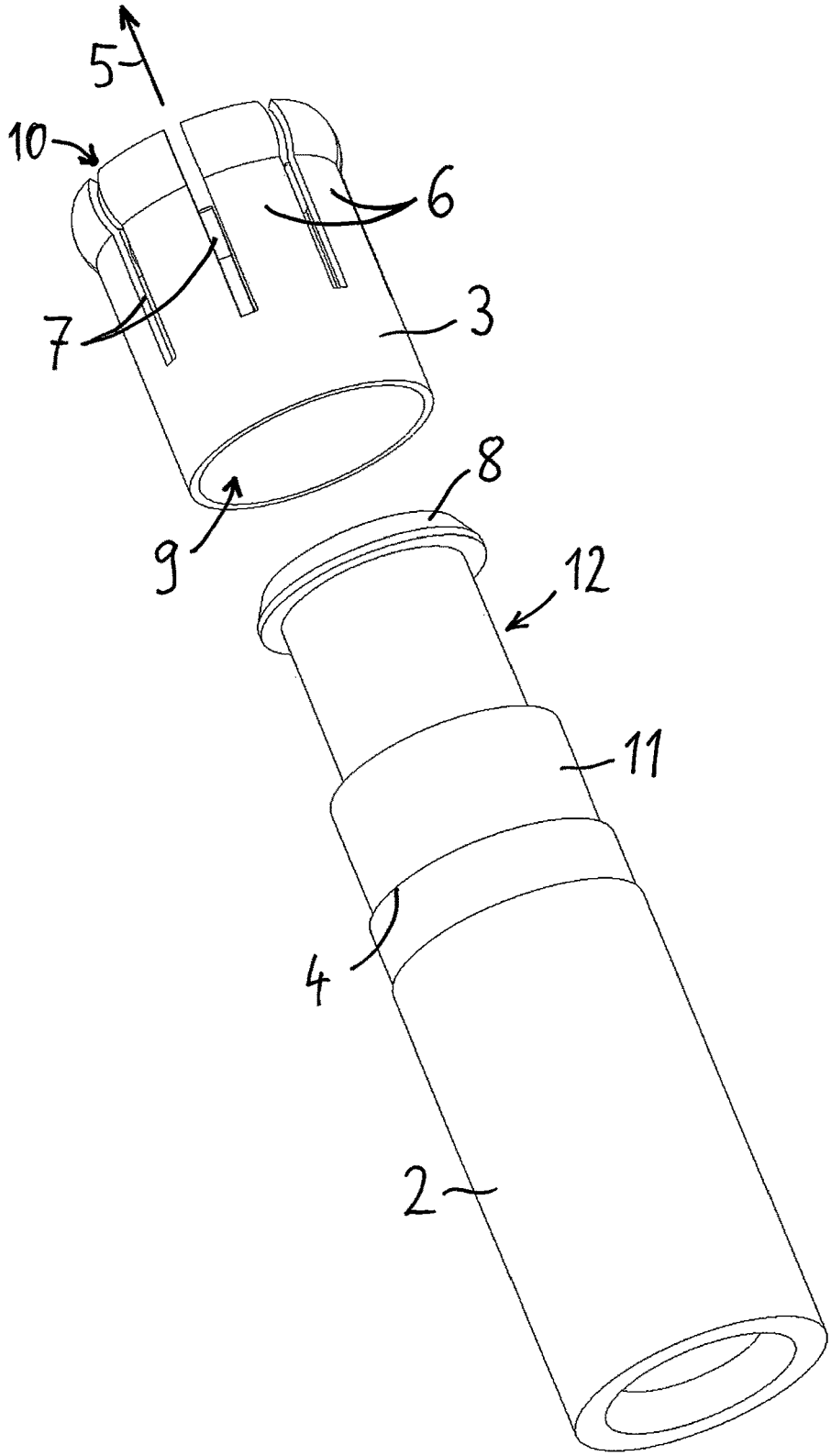
FIG. 2 shows an exploded view of the connecting plug.

FIG. 2 shows the assembly of the connecting plug 1. The lamella sleeve 3 comprises a rear opening 9 and a front opening 10. Viewed in the mating direction 5, the lamella sleeve 3 comprises an annular carrier part in the rear portion of the lamella sleeve 3 and a plurality of lamellae 6 arranged in the front portion of the lamella sleeve 3, the lamellae 6 being formed integrally with the annular carrier part, wherein the lamellae 6 extend predominantly in the mating direction 5. For assembling the connecting plug 1, the central pin 2 is inserted into the rear opening 9 of the lamella sleeve 3 and the lamella sleeve 3 is pushed onto the central pin 2 and fixed to the central pin 2. In the embodiment shown in FIGS. 1 to 5*b*, the central pin extends through the rear opening 9, through the entire lamella sleeve 3 and through the front opening 10. The lamella sleeve 3 encloses an axial segment of the central pin 2. In an alternative embodiment, which is not shown in the figures, the central pin may extend through the rear opening and partly through the lamella sleeve, without extending through the front opening of the lamella sleeve. Also in this embodiment, the lamella sleeve is fixed to the central pin and encloses an axial segment of the central pin.

Figure 3A:
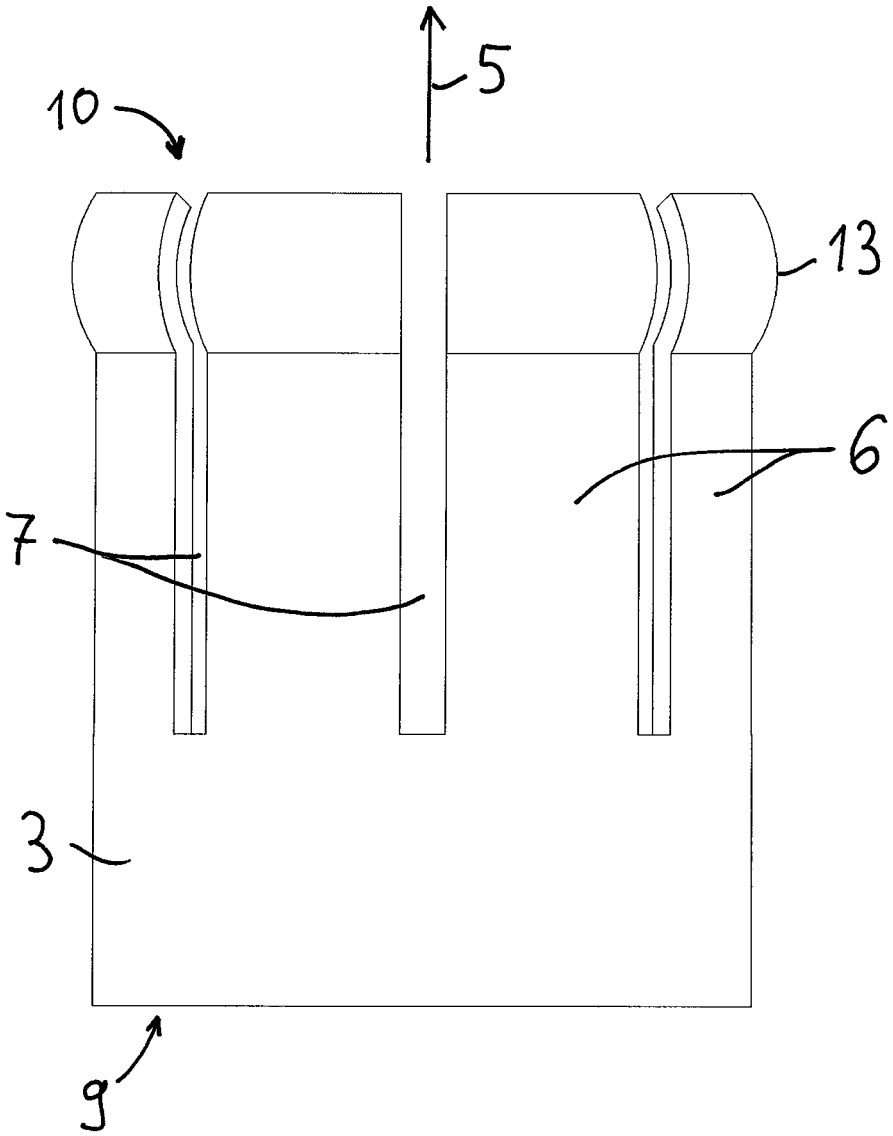
FIG. 3*a* shows a side view of the lamella sleeve.
Figure 3B:
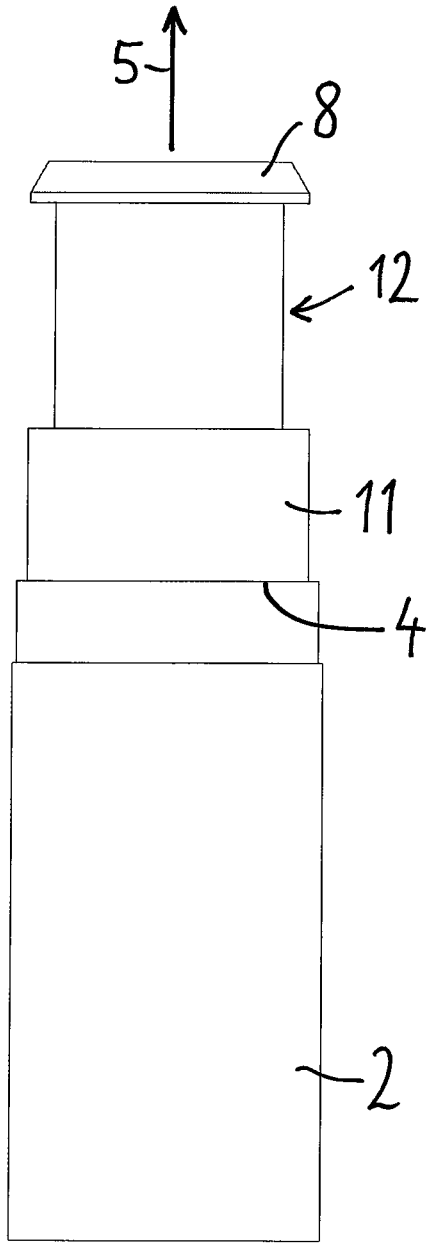
FIG. 3*b* shows a side view of the connecting plug's central pin.

As shown in FIG. 2 and in FIG. 3*b*, the central pin 2 comprises a circumferential recess 11. When the lamella sleeve 3 is pushed onto the central pin 2, the rear end of the lamella sleeve 3 abuts against the rear end of the circumferential recess 11. The lamella sleeve 3 is fixed to the central pin 2 such that the rear end of the lamella sleeve 3 is located at the predefined axial position 4. Additionally or alternatively, the central pin 2 may comprise a tapered portion. In this case, when the lamella sleeve 3 is pushed onto the tapered portion of the central pin 2, a press fit is established between the lamella sleeve 3 and the central pin 2. For joining the central pin 2 and the lamella sleeve 3, a plurality of other joining techniques such as for example flanging, crimping, clamping or beading may be used for forming a fixed connection between the central pin 2 and the lamella sleeve 3.

As shown in FIG. 2, the central pin 2 comprises a circumferential groove 12 disposed at the front portion of the central pin 2. The groove 12 is arranged such that a free space is provided behind the lamellae 6. Due to the presence of the groove 12, each of the lamellae 6 can be elastically deformed in a radially inwards direction.

FIG. 3*a* shows a side view of the lamella sleeve 3. The lamella sleeve 3 comprises the rear opening 9, the front opening 10 and a plurality of lamellae 6. Viewed in the mating direction 5, the lamellae 6 are disposed in the front portion of the lamella sleeve 3, with the free ends of the lamellae 6 facing towards the front end of the lamella sleeve 3. In the front portion of the lamella sleeve 3, the slots 7 segment the front portion of the lamella sleeve 3 into the plurality of lamellae 6. In the example of FIG. 3*a*, each of the lamellae 6 comprises a bulge 13 disposed at the outer surface of the lamellae 6. When the connecting plug 1 is inserted into the corresponding socket, the bulge 13 serves as a contact area. The lamella sleeve 3 consists of conductive material, preferably of metal. The lamella sleeve 3 may for example be a rotationally symmetric part that is formed in one piece. The lamella sleeve 3 may for example be formed by deep drawing.

FIG. 3*b* shows a side view of the central pin 2. The central pin 2 comprises the tip 8, the groove 12 and the circumferential recess 11. The lamella sleeve 3 is pushed onto the central pin 2 until the lamella sleeve 3 abuts against the rear end of the circumferential recess 11, with the axial position 4 indicating the end position of the lamella sleeve's rear end. The central pin 2 consists of conductive material, preferably of metal. The central pin 2 is a solid part. The central pin 2 is a rotationally symmetric part. Preferably, the central pin 2 is formed by turning.

Figure 4:
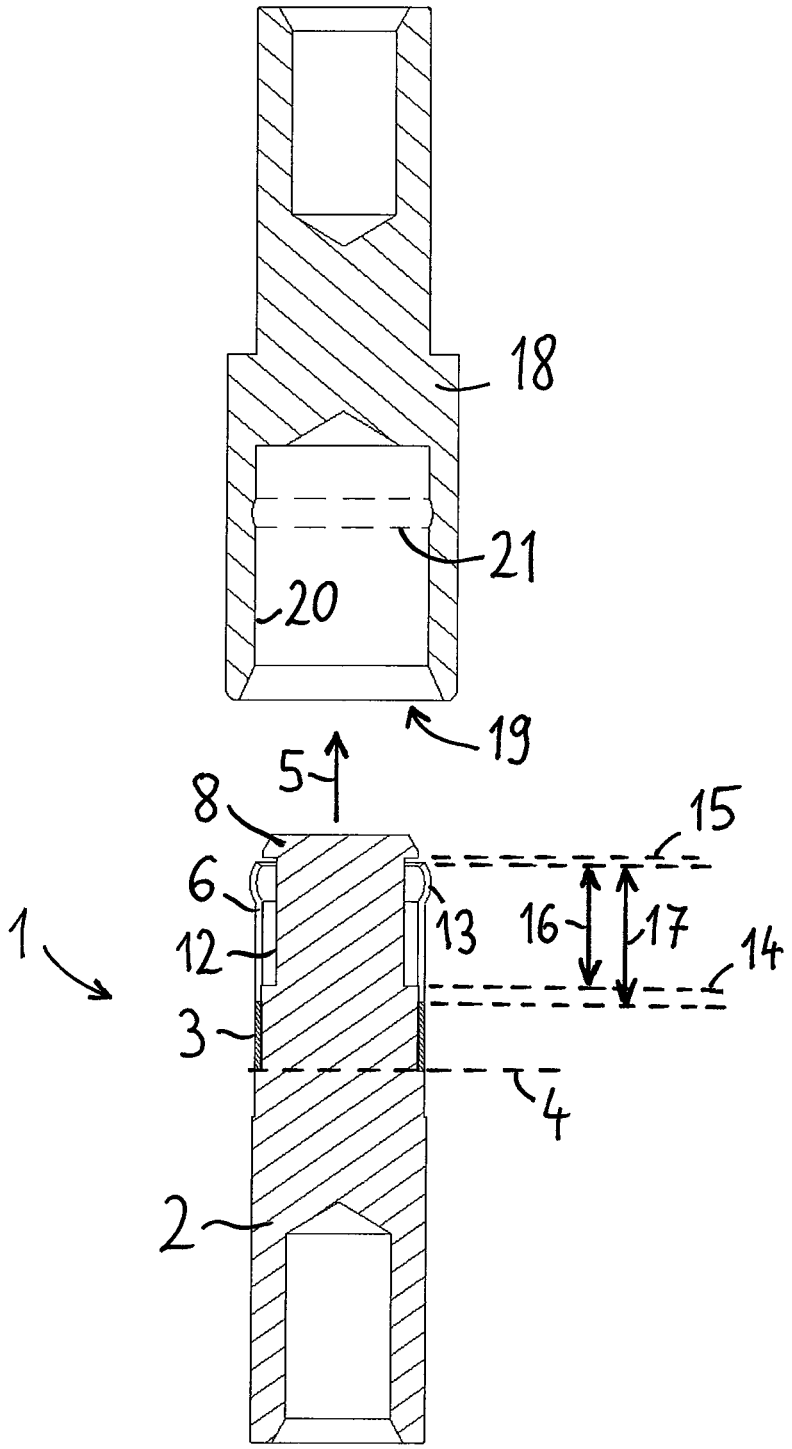
FIG. 4 shows a longitudinal section of a plug-in connector comprising a connecting plug and a socket.

FIG. 4 shows a longitudinal section of the connecting plug 1 and a socket part 18. The lamella sleeve 3 is fixed to the central pin 2 and circumferentially encloses an axial segment of the central pin 2. The circumferential groove 12 provides a free space behind the front portion of the lamellae 6, such that the front portion of the lamellae 6 can be elastically deformed in a radially inwards direction of the lamella sleeve 3. The groove 12 is arranged such that the groove 12 overlaps with the front portion of the lamellae 6 when viewed in the mating direction 5. The groove 12 extends from the axial position 14 of the groove's rear end to the axial position 15 of the groove's front end, with the front end of the groove 12 being arranged such that the groove 12 extends beyond the free ends of the lamellae 6 when viewed in the mating direction 5.

In FIG. 4, both the length 16 of the deformable portion of the lamellae 6 and the length 17 of the lamellae 6 are indicated. The rear end of the groove 12 serves as an abutting edge for the lamellae 6. In this regard, the axial position 14 of the groove's rear end determines the length 16 of the deformable portion of the lamellae 6. Hence, by varying the axial position 14 of the groove's rear end, the spring tension of the lamellae 6 can be varied. The longer the deformable portion is, the softer the spring tension of the lamellae 6 will be. In contrast, by reducing the length 16 of the deformable portion, a comparatively hard spring tension of the lamellae 6 is obtained. In this regard, the axial position 14 of the rear end of the groove 12 determines the spring tension of the lamellae 6. The spring tension determines the insertion force when inserting the connecting plug 1 into a corresponding socket.

Furthermore, the depth of the groove 12 determines the maximum possible deflection of the lamellae 6 in a radially inwards direction. In this regard, the bottom of the groove 12 serves as a supporting surface for the lamellae 6. Thus, the lamellae 6 are protected from being damaged, because when pushing the lamellae 6 in a radially inwards direction, the bottom of the groove 12 serves as a limit stop for the deformation of the lamellae, such that any plastic deformation of the lamellae 6 is prevented.

The tip 8 may for example protrude from the bottom of the groove 12 in a radially outward direction in a way that the free ends of the lamellae 6 are protected. In particular, any plastic deformation of the lamellae 6 is prevented. For example, it is prevented that any item can be inserted in the interspace between the free ends of the lamellae 6 and the central pin 2.

The plug-in connector shown in FIG. 4 further comprises a socket part 18 with an opening 19 configured for accommodating the connecting plug 1. The inner walls 20 of the socket part 18 may for example have an even surface. In this case, the bulges 13 of the lamellae are resiliently pressed against the inner walls 20 and thus, an electrical connection is established between the connecting plug 1 and the socket part 18. Optionally, the socket part 18 may further comprise a circumferential groove 21 disposed in the interior of the socket part 18. In FIG. 4, the circumferential groove 21 is indicated with dashed lines. If the connecting plug 1 is inserted into the opening 19 of the socket part 18, the bulges 13 of the lamellae 6 will engage with the circumferential groove 21. Hence, in this embodiment, the bulges 13 are implemented as latching elements configured for latching with the circumferential groove 21, which serves as a counter-latching element. In this example, the interaction between the bulges 13 and the circumferential groove 21 determines the pulling force required for unplugging the connecting plug 1 from the socket part 18. Due to the latching mechanism, the mechanical stability of the plug-in connection can be improved.

Figure 5A:
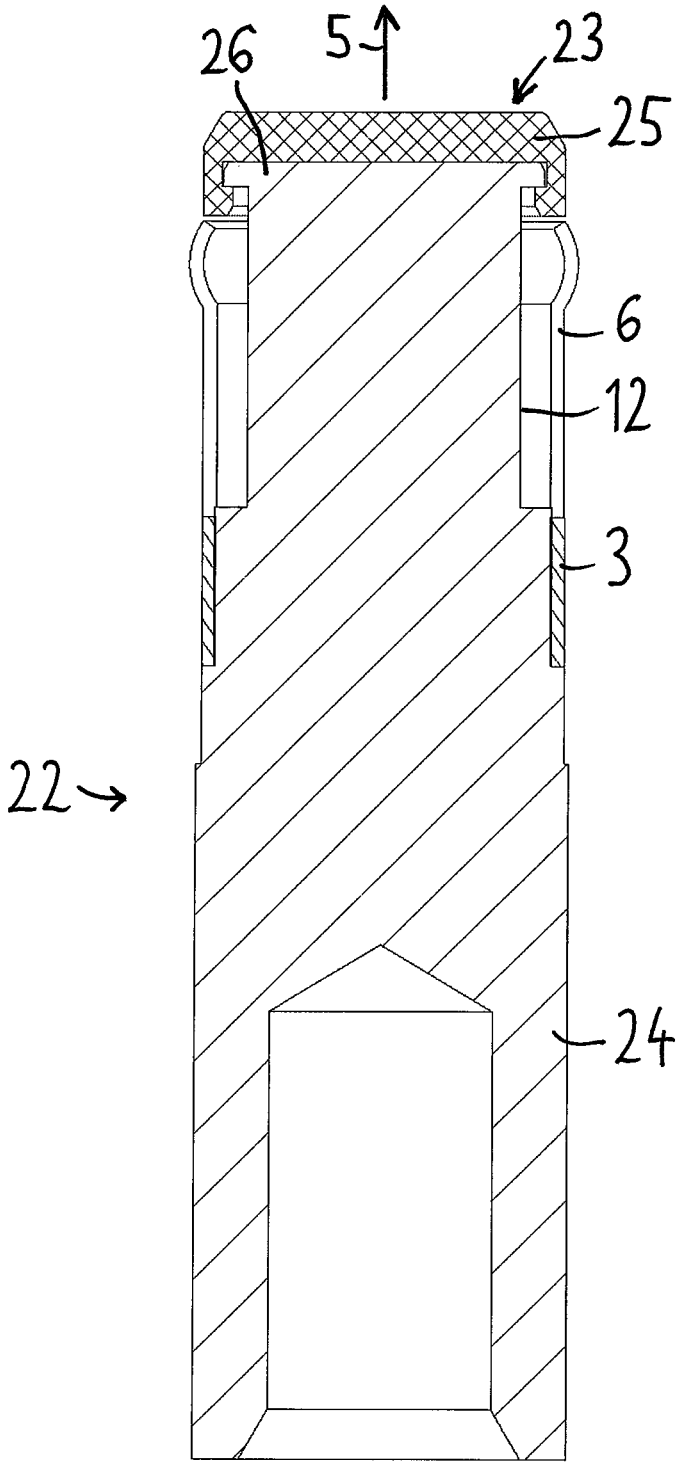
FIG. 5*a* shows a connecting plug with an insulating cap disposed at the front end of the contact pin.

In FIG. 5*a*, a further example of a connecting plug 22 is depicted. As in the examples described before, the connecting plug 22 comprises a lamella sleeve 3 with a plurality of lamellae 6, with the free ends of the lamellae 6 being oriented towards the front end of the connecting plug 22 when viewed in the mating direction 5. The lamella sleeve 3 is fixed to the central pin 23 and circumferentially encloses an axial segment of the central pin 23. In contrast to the example shown in FIGS. 1 to 4, the central pin 23 is not implemented in one piece. Instead, in FIG. 5*a*, the central pin 23 comprises a contact pin 24 and an insulating cap 25 configured for covering the tip 26 of the contact pin 24. In FIG. 5*a*, it can be seen that the central pin 23 extends through the rear opening 9, through the lamella sleeve 3 and through the front opening 10 of the lamella sleeve 3.

The contact pin 24 consists of conductive material, preferably of metal. Further preferably, the contact pin 24 is formed as a turned part. The insulating cap 25 is made of insulating material, for example of plastic material, natural rubber or synthetic rubber. The insulating cap 25 may for example be formed by injection molding. The insulating cap 25 may be implemented as a snap-in member configured for being mounted on the tip 26 of the contact pin 24. The insulating cap 25 serves as a touch protection and prevents that a user may inadvertently touch life parts of the connecting plug 22.

Figure 5B:
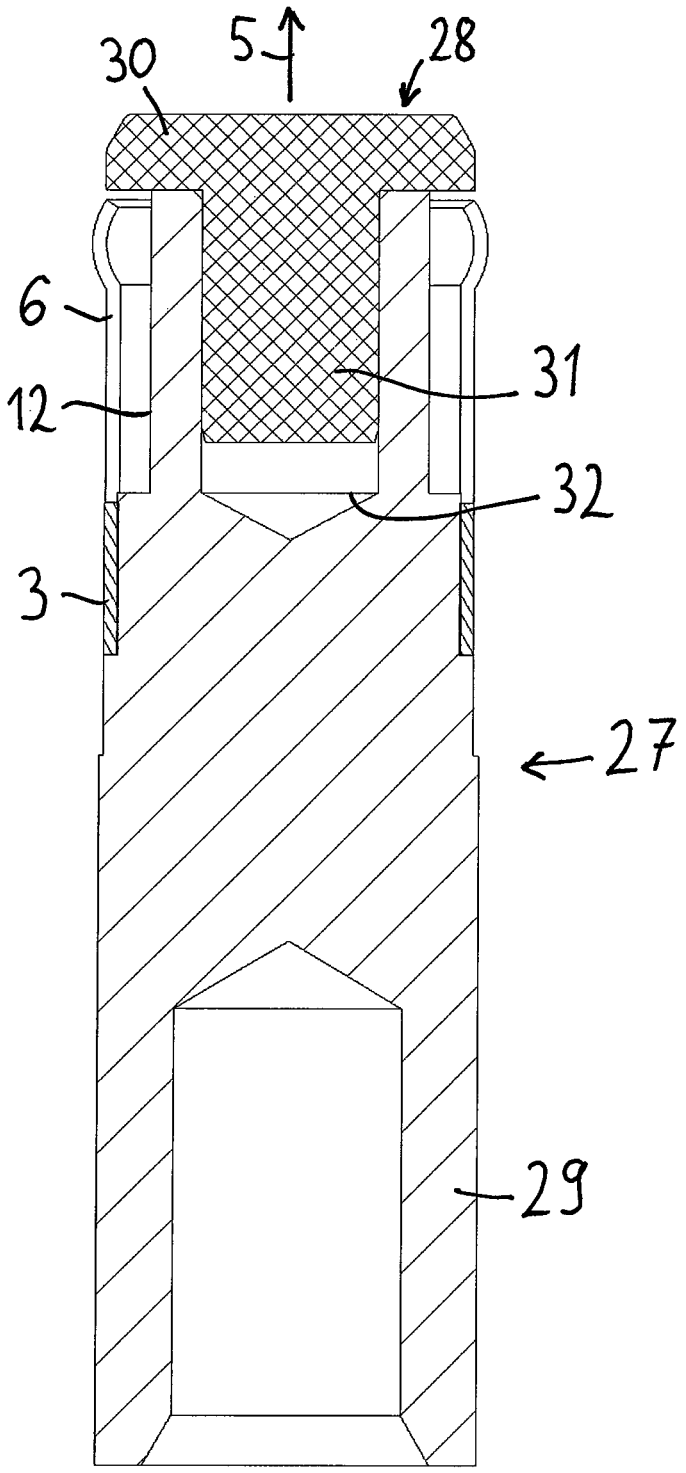
FIG. 5*b* shows a connecting plug with an insulating end part disposed at the front end of the contact pin.

FIG. 5*b* shows yet another example of a connecting plug 27. Also in this example, the central pin 28 is not implemented in one piece, but comprises two different components. In particular, the central pin 28 comprises a contact pin 29 and an insulating end part 30 disposed at the front end of the contact pin 29. The insulating end part 30 comprises a protruding member 31 that is inserted into the corresponding bore hole 32 of the contact pin 29. In FIG. 5*b*, it can be seen that the central pin 28 extends through the rear opening 9, through the lamella sleeve 3 and through the front opening 10 of the lamella sleeve 3.

The contact pin 29 consists of electrically conducting material, preferably of metal. The contact pin 29 may for example be a turned part. The insulating end part 30 is made of insulating material, for example of plastic material, natural rubber or synthetic rubber. The insulating end part 30 may for example be formed by injection molding. The insulating end part 30 serves as a touch protection. For joining the insulating end part 30 and the contact pin 29, a variety of different joining techniques may be used, like for example screwing, caulking, establishing a press fit, etc. Alternatively, the insulating end part 30 may for example comprise one or more snap-in members configured for establishing a snap-fit with the contact pin 29.

Figure 6:
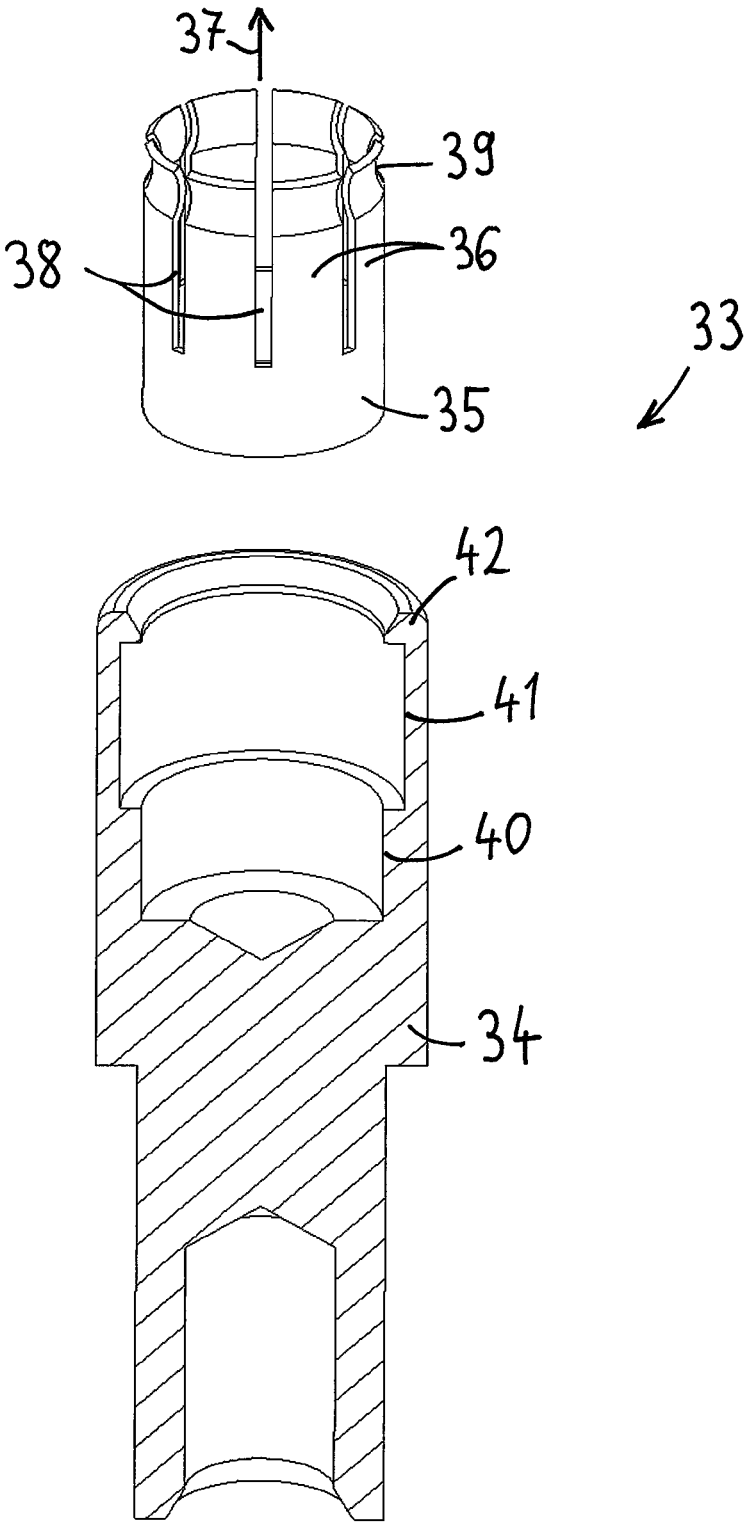
FIG. 6 shows an exploded view of a socket with a lamella sleeve.

Instead of fixing the lamella sleeve to a central pin, the lamella sleeve may as well be fixed inside a socket. In this case, the connecting plug may for example be a plain connector pin. In FIG. 6, a socket 33 comprising a socket element 34 and a lamella sleeve 35 disposed in the interior of the socket element 34 is shown. The lamella sleeve 35 comprises an annular carrier part and a plurality of lamellae 36, with each of the lamellae 36 having a first end coupled to the lamella sleeve's annular carrier part and a second end that is realised as a free end. Viewed in the mating direction 37 of the socket 33, the lamella sleeve's annular carrier part is located at a rear portion of the lamella sleeve 35 and the lamellae 36 are disposed at a front portion of the lamella sleeve 35, with the lamellae's free ends being oriented towards the front end of the socket 33. The lamella sleeve 35 comprises a plurality of slots 38 that extend from the lamella sleeve's front end in a predominantly axial direction and segment the front portion of the lamella sleeve 35 into a plurality of lamellae 36. Preferably, the lamellae 36 are formed integrally with the annular carrier part. The lamellae 36 extend from the lamella sleeve's annular carrier part predominantly in the mating direction 37 of the socket 33. Each of the lamellae 36 may comprise one or more bulges 39 configured for being resiliently pressed in a radially inwards direction, in order to establish an electrical contact with a connector pin that is inserted into the socket 33. Each of the bulges 39 may stand out in a radially inwards direction. The lamella sleeve 35 consists of conductive material, preferably of metal. The lamella sleeve 35 may for example be a deep drawn part.

The socket 33 further comprises the socket element 34 with an opening 40 configured for accommodating the rear part of the lamella sleeve 35. The socket element 34 further comprises a circumferential groove 41, with the inner diameter of the circumferential groove 41 being larger than the inner diameter of the opening 40. The circumferential groove 41 is configured for providing a free space behind the lamellae 36 of the lamella sleeve 35 such that the lamellae 36 can be resiliently deformed in a radially outwards direction. Furthermore, the socket element 34 comprises a front end part 42 that protrudes in a radially inwards direction. The front end part 42 at least partly covers the free ends of the lamellae 36, thus protecting the lamellae 36. The socket element 34 consists of conductive material, preferably of metal. The socket element 34 may for example be implemented as a turned part.

Figure 7:
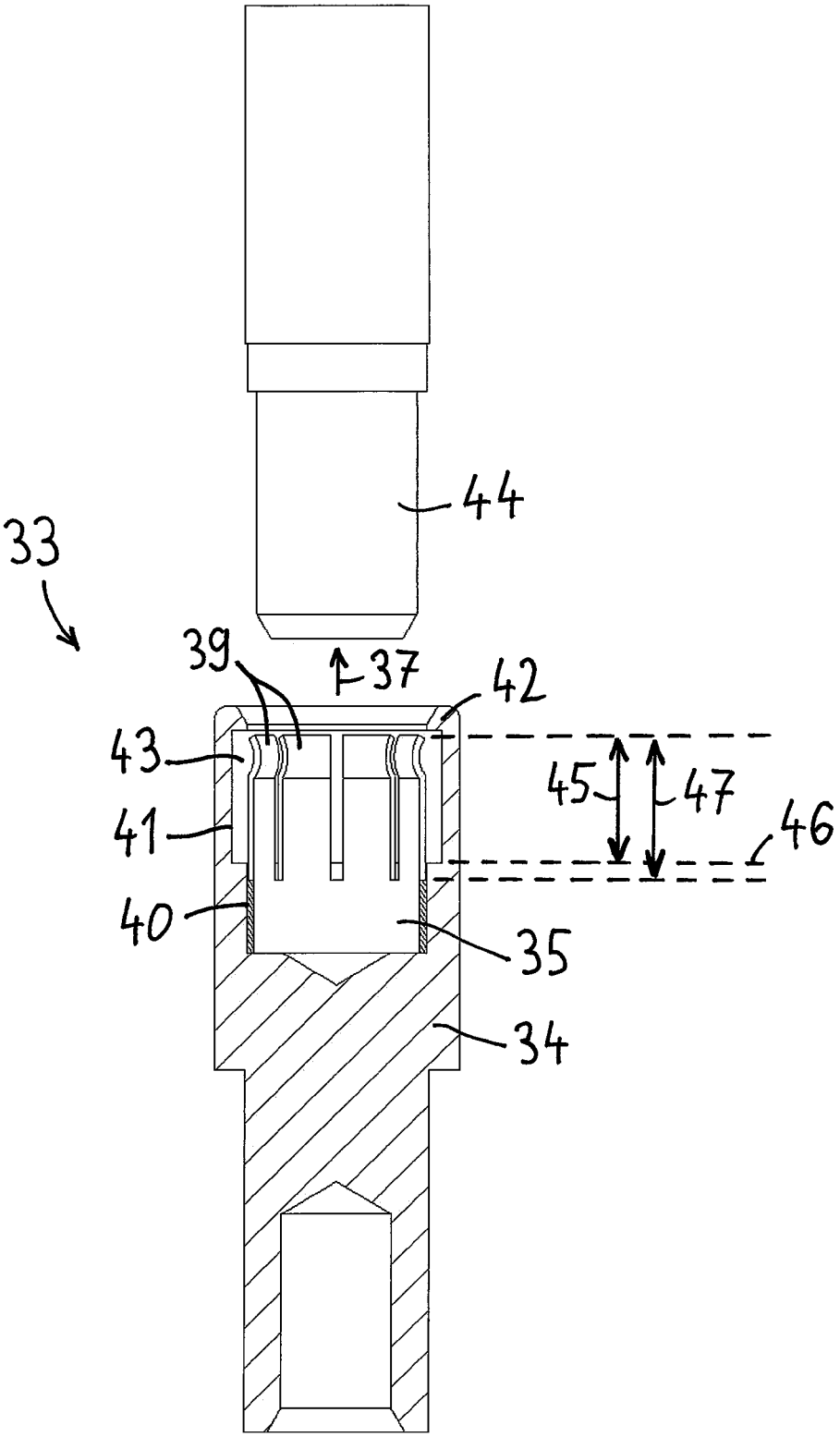
FIG. 7 shows a longitudinal section of the socket together with a connector pin.

FIG. 7 shows a longitudinal section of the socket 33 together with a connector pin 44. The socket 33 comprises a socket element 34 with an opening 40 configured for accommodating the lamella sleeve 35, with the lamellae 36 extending in the mating direction 37 towards the front end of the socket 33. The circumferential groove 41 extends from the opening 40 in a radially outwards direction. The circumferential groove 41 is disposed behind the deformable portion of the lamellae 36. The circumferential groove 41 is configured for providing a free space 43 behind the lamellae 36, the free space 43 being located radially outward of the lamellae 36.

When viewed in the mating direction 37, the circumferential groove 41 extends beyond the front end of the lamellae 36 so that the circumferential groove 41 overlaps with the front portion of the lamellae 36. Due to the presence of the circumferential groove 41, the lamellae 36 can be resiliently deformed in a radially outward direction. When the lamellae 36 are resiliently deformed, they may enter the free space 43 provided by the circumferential groove 41. For example, in case a connector pin 44 is inserted into the socket 33, the lamellae 36 of the socket 33 will be deflected in a radially outward direction, with the bulges 39 being resiliently pressed against the outer surface of the connector pin 44.

In this regard, the depth of the circumferential groove 41 determines the maximum possible deflection of the lamellae 36 in a radially outward direction. The circumferential groove 41 serves as a limit stop configured for limiting the resilient deformation of the lamellae 36 in the radially outward direction. In this regard, the circumferential groove 41 acts as a support for the lamellae 36 and prevents any plastic deformation of the lamellae 36.

As shown in FIG. 7, the rear end of the circumferential groove 41 serves as an abutting edge for the lamellae 36. For this reason, the length 45 of the deformable portion of the lamellae 36 is determined by the axial position 46 of the rear end of the circumferential groove 41. In FIG. 7, the length 47 of the lamellae 36 is also indicated. The axial position 46 of the rear end of the groove 41 determines the spring tension of the lamellae 36. The longer the deformable portion of the lamellae 36 is, the softer the spring tension of the lamellae 36 will be. In contrast, by reducing the length 45 of the deformable portion, a comparatively hard spring tension of the lamellae 36 is obtained. By choosing an adequate axial position 46 of the rear end of the groove 41, the spring tension of the lamellae 36 can be set to a desired value. Thus, the insertion force for inserting the connector pin 44 into the socket 33 can be adjusted.

The lamella sleeve 35 shown in FIG. 7 has both a front opening and a rear opening. Alternatively, a lamella sleeve with a closed base may be used as well.

The features described in the above description, claims and figures can be relevant to the invention in any combination. Their reference numerals in the claims have merely been introduced to facilitate reading of the claims. They are by no means meant to be limiting.

LIST OF REFERENCE NUMERALS

1 connecting plug
2 central pin
3 lamella sleeve
4 predefined axial position
5 mating direction
6 lamellae
7 slots
8 tip
9 rear opening of the lamella sleeve
10 front opening of the lamella sleeve
11 circumferential recess
12 groove
13 bulge
14 axial position of the groove's rear end
15 axial position of the groove's front end
16 length of the deformable portion of the lamellae
17 length of the lamellae
18 socket part
19 opening
20 inner walls
21 circumferential groove
22 connecting plug
23 central pin
24 contact pin
25 insulating cap
26 tip
27 connecting plug
28 central pin
29 contact pin
30 insulating end part
31 protruding member
32 bore hole
33 socket
34 socket element
35 lamella sleeve
36 lamellae
37 mating direction
38 slots
39 bulges
40 opening
41 circumferential groove
42 front end part of the socket element
43 free space
44 connector pin
45 length of deformable portion of lamellae
46 axial position of rear end of recess
47 length of lamellae

The invention claimed is:

1. A connecting plug comprising:
a central pin; and
a lamella sleeve comprising
a front opening,
a rear opening, and
a plurality of lamellae, wherein the lamella sleeve circumferentially encloses an axial segment of the central pin, wherein the lamella sleeve is fixed to the central pin, wherein the central pin extends through the rear opening of the lamella sleeve, and through the lamella sleeve, and through the front opening of the lamella sleeve, wherein the central pin comprises a groove, a recess or at least one indentation, wherein the groove, the recess or the at least one indentation is arranged to form a free space is provided behind front portions of the plurality of lamellae, and wherein a rear edge of the groove, the recess or the at least one indentation serves as an abutting edge for at least one of the plurality of lamellae.

2. The connecting plug of claim 1, wherein each of the plurality of lamellae is elastically deformable in a radially inward direction of the lamella sleeve.

3. The connecting plug of claim 1, wherein each of the plurality of lamellae has a first end coupled to an annular carrier part of the lamella sleeve and a second end that is implemented as a free end, wherein the free ends of the plurality of lamellae facing towards a front end of the connecting plug.

4. The connecting plug of claim 1 wherein the lamella sleeve is a deep drawn part.

5. The connecting plug of claim 1 wherein the central pin is a turned part.

6. The connecting plug of claim 1 wherein the lamella sleeve is fixed to the central pin using at least one of the following joining techniques: flanging, crimping, beading, clamping, and establishing a press fit.

7. The connecting plug of claim 1, wherein a respective depth of the groove, of the recess or of the at least one indentation determines a maximum deflection of the plurality of lamellae.

8. The connecting plug of claim 1, wherein an axial position of a rear end of the groove, of the recess or of the at least one indentation relative to the lamella sleeve determines a length of the respective deformable portions of the plurality of lamellae.

9. The connecting plug of claim 1, wherein an axial position of a rear end of the groove, the recess or the at least one indentation relative to the lamella sleeve determines the spring tension of at least one of the plurality of lamellae.

10. A connecting plug, comprising:

a central pin;

a lamella sleeve comprising a front opening, a rear opening, an annular carrier part, and a plurality of lamellae, wherein the central pin extends through the rear opening of the lamella sleeve and at least partly through the lamella sleeve, wherein the lamella sleeve circumferentially encloses an axial segment of the central pin, wherein the lamella sleeve is fixed to the central pin, wherein when viewed in the connecting plug's mating direction, the annular carrier part is located at a rear portion and the plurality of lamellae are located at a front portion of the lamella sleeve, wherein each of the plurality of lamellae has a first end coupled to the annular carrier part and a second end that is implemented as a free end, with the free ends of the plurality of lamellae facing towards the front end of the connecting plug, and wherein the central pin comprises a groove, a recess or at least one indentation to form a free space is provided behind the front portions of the plurality of lamellae, wherein a rear edge of the groove, of the recess or of the at least one indentation serves as an abutting edge for the lamellae.

11. A connecting plug arrangement, comprising:

a connecting plug comprising a central pin; and a lamella sleeve comprising a front opening, a rear opening, and a plurality of lamellae, wherein the lamella sleeve circumferentially encloses an axial segment of the central pin, wherein the lamella sleeve is fixed to the central pin, wherein the central pin extends through the rear opening of the lamella sleeve, and through the lamella sleeve, and through the front opening of the lamella sleeve, wherein the central pin comprises a groove, a recess or at least one indentation, wherein the groove, the recess or the at least one indentation is arranged to form a free space is provided behind front portions of the plurality of lamellae, and wherein a rear edge of the groove, the recess or the at least one indentation serves as an abutting edge for at least one of the plurality of lamellae; and a corresponding socket.

12. A method for forming a connecting plug by assembling a central pin and a lamella sleeve, wherein the lamella sleeve comprises a front opening, a rear opening, a closed annular carrier part, and a plurality of lamellae, wherein the central pin comprising a groove, a recess or at least one indentation to form a free space is provided behind the front portions of the plurality of lamellae, wherein a rear edge of the groove, of the recess or of the at least one indentation serves as an abutting edge for the lamellae, the method comprising:

sliding the lamella sleeve on the central pin, with the central pin extending through the rear opening of the lamella sleeve, through the lamella sleeve, and through the front opening of the lamella sleeve, wherein the lamella sleeve circumferentially encloses an axial segment of the central pin; and fixing the lamella sleeve to the central pin.

13. A connecting socket, comprising:

a lamella sleeve comprising a front opening, an annular carrier part and a plurality of lamellae, wherein each of the plurality of lamellae has a first end that is integrally formed with the annular carrier part and a second end that is implemented as a free end; and a socket element with an opening configured for accommodating at least a rear part of the lamella sleeve, wherein the socket element comprises a recess or a groove or at least one indentation that projects from an internal wall in the opening in a radially outwards direction to form a free space is behind front portions of the plurality of lamellae of the lamella sleeve when positioned in the socket element, and wherein a rear edge of the recess, groove, or the at least one indentation serves as an abutting edge for the plurality of lamellae of the lamella sleeve.

14. A connecting plug arrangement, comprising:

a connecting plug, comprising a central pin;

a lamella sleeve comprising a front opening, a rear opening, an annular carrier part, and a plurality of lamellae, wherein the central pin extends through the rear opening of the lamella sleeve and at least partly through the lamella sleeve, wherein the lamella sleeve circumferentially encloses an axial segment of the central pin, wherein the lamella sleeve is fixed to the central pin, wherein when viewed in the connecting plug's mating direction, the annular carrier part is located at a rear portion and the plurality of lamellae are located at a front portion of the lamella sleeve, wherein each of the plurality of lamellae has a first end coupled to the annular carrier part and a second end that is implemented as a free end, with the free ends of the plurality of lamellae facing towards the front end of the connecting plug, and wherein the central pin comprises a groove, a recess or at least one indentation to form a free space is provided behind the front portions of the plurality of lamellae, wherein a rear edge of the groove, of the recess or of the at least one indentation serves as an abutting edge for the lamellae; and a corresponding socket.

* * * * *